United States Patent [19]

Chorkey

[11] Patent Number: 4,587,991

[45] Date of Patent: May 13, 1986

[54] VALVE WITH UNIPLANAR FLOW

[76] Inventor: William J. Chorkey, 34300 Lyncroft, Farmington, Mich. 48024

[21] Appl. No.: 464,872

[22] Filed: Feb. 8, 1983

[51] Int. Cl.[4] ..... F15B 13/042

[52] U.S. Cl. ..... 137/454.6; 137/625.66; 137/625.69; 137/884

[58] Field of Search ..... 137/454.2, 454.6, 625.65, 137/625.66, 625.69, 884; 251/367

[56] References Cited

U.S. PATENT DOCUMENTS

| | | | |
|---|---|---|---|
| 2,879,788 | 3/1959 | Beckett et al. | 137/454.6 |
| 3,089,517 | 5/1963 | Ludwig | 137/625.63 |
| 3,152,614 | 10/1964 | Carls | 137/625.69 |
| 3,254,675 | 6/1966 | Johnson | 137/625.65 |
| 3,952,775 | 4/1976 | Ogata | 137/625.69 X |
| 4,485,846 | 12/1984 | Neff | 137/454.2 X |

*Primary Examiner*—Gerald A. Michalsky
*Attorney, Agent, or Firm*—Irvin L. Groh

[57] ABSTRACT

A reversing fluid flow control valve with a valve base having an elongated longitudinal cavity open along the top side thereof. Said valve base having inlet, cylinder and exhaust ports connected to inlet cylinder and exhaust passages. A valve spool body removably mounted on the valve base and having a shape on the lower side thereof complimentary with the shape in the valve base so that fluid passing through the valve and between said ports flows in a uniplanar manner.

5 Claims, 5 Drawing Figures

VALVE WITH UNIPLANAR FLOW

TECHNICAL FIELD

This invention relates generally to the valve art, and more particularly, to an improved fluid flow control valve which has a valve body nested in a valve base, so as to provide a fluid flow control valve through which the fluid flows with a straight through or uniplanar flow. The valve of the present invention is adapted for use in air and hydraulic fluid flow control valves of the three-way or four-way reversing spool type, and the like, for directing fluid to control apparatus, such as cylinders for machine tool operation and other industrial applications.

BACKGROUND ART

It is well known in the valve art that the most efficient flow path through a flow control valve is one which is short as possible between an inlet port and an outlet port. Heretofore, four-way fluid flow control valves ordinarily require a base member on which is mounted a body member carrying a valve spool member, and with the inlet and outlet passages extending through both the base member and the body member, and then back into the base member for outlet purposes. Such a prior art valve structure permits the removal of the valve body from the base of the valve without disconnecting any conduits attached to the base entrance and exit ports for conveying fluid to and from the valve. However such prior art valve structures require many turns in the flow of the fluid through the valve. For example, in valves having the inlet and outlet ports on the side of the base member, there are required at least eight right angle turns to be made by the fluid between the inlet and outlet ports. U.S. Pat. No. 3,680,596 discloses a spool type reversing valve, which has the valve spool slidably mounted in a valve body, which is in turn mounted on a valve base. When the fluid passes through a valve such as that shown in the last mentioned patent it must make many right angle turns, and at each turn there is a pressure drop. In an attempt to decrease the number of right angle turns in a flow circuit through a four-way reversing valve it has been heretofore proposed that a circular flow pattern through the valve body be employed to increase the flow efficiency. Such a flow pattern is illustrated in U.S. Pat. No. 3,089,517. However the circular flow path employed in the last mentioned patent still employs about as many right angle turns, or substantially right angle turns, as are employed in the valve shown in the first mentioned patent, in the fluid flow circuit therethrough. Another prior art reversing valve employing a circular flow path, with many right angle turns, is shown in U.S. Pat. No. 3,952,775.

DISCLOSURE OF THE INVENTION

In accordance with the present invention, a fluid flow reversing valve is provided for use in air or hydraulic fluid flow control applications. The invention can be incorporated in a three-way or four-way reversing spool type valve, for directing fluid to control apparatus, such as cylinders for machine tool operations and other industrial applications. The valve of the present invention is constructed and arranged to provide for a uniplanar fluid flow path through the valve, so as to provide a straight through efficient fluid flow.

The valve of the present invention includes a base member having a cavity formed therein, and in which can be quickly and easily mounted, a spool valve. The spool valve can be of any conventional type, as for example, a pilot air operated solenoid type or a direct operated solenoid type, both with a spring return, or a double solenoid pilot air operated type, or direct, double solenoid, operated type, or a spool valve type which is manually operated, or operated by foot, or a cam means, or any other suitable means. The valve of the present invention provides a reversing valve which is compact in construction and which has an overall low height, and yet has all the advantages of a base mounted reversing valve wherein the spool valve can be quickly and easily removed frm the base, without removing the conductors or pipes from the base which conduct the pressurized fluid to the valve and to the apparatus being controlled by the valve and, which conduct exhaust fluid from the valve. The valve of the present invention can be used in a stacking arrangement with a plurality of the valves, or with a combination of reversing valves of the present invention and other type reversing valves.

An advantage of the reversing valve of the present invention is that it is a simpler structure than the corresponding prior art reversing valves, and such simple structure results in lower tooling and manufacturing costs.

BEST MODE OF CARRYING OUT THE INVENTION

Figure 1:
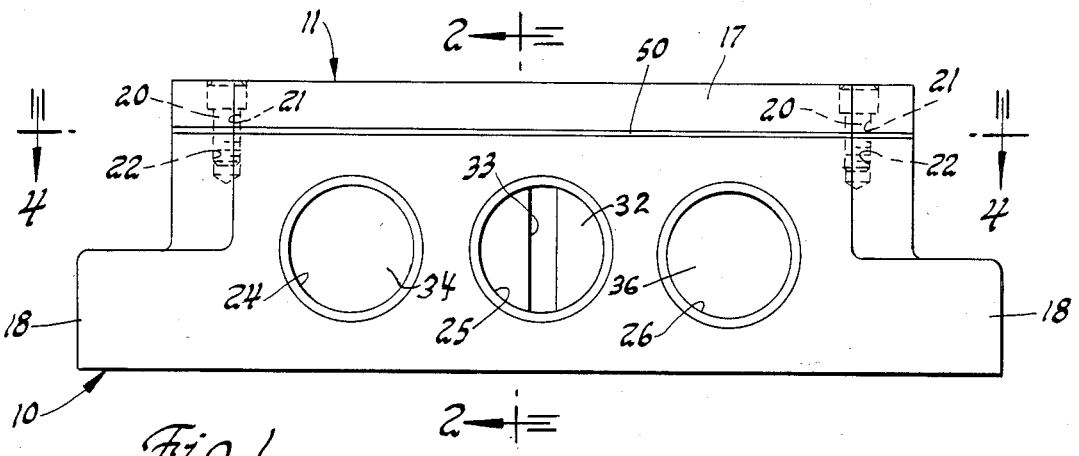
FIG. 1 is a side elevational view of a four-way reversing fluid flow control valve made in accordance with the principles of the present invention.
Figure 2:
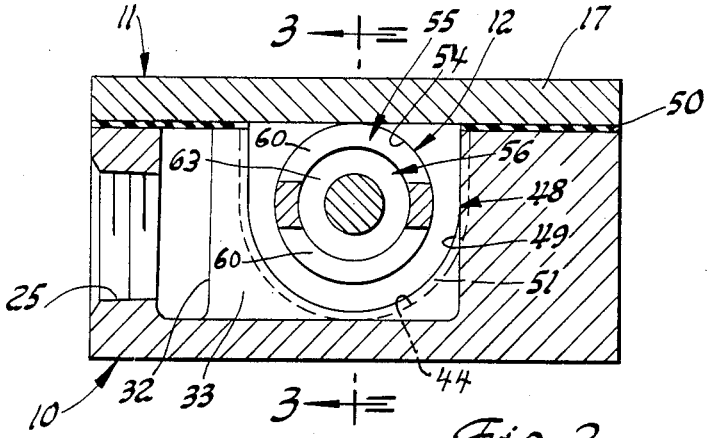
FIG. 2 is an elevational section view of the valve structure illustrated in FIG. 1, taken along the line 2—2 thereof, and looking in the direction of the arrows.
Figure 3:
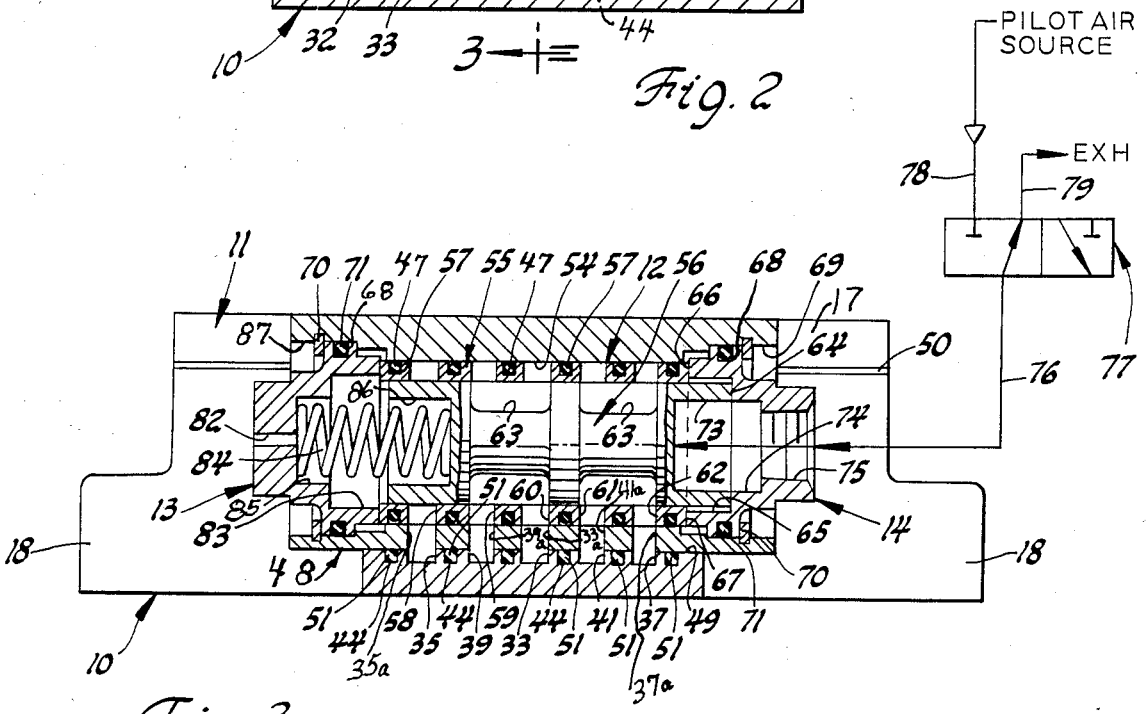
FIG. 3 is a longitudinal section view of the valve structure illustrated in FIG. 2, taken along the line 3—3 thereof, and looking in the direction of the arrows.

Referring now to the drawings, and in particular to FIGS. 1 through 4, the numeral 10 generally designates a four-way reversing valve base made in accordance with the principles of the present invention. Operatively on the valve base 10 is a valve body, generally indicated by the numeral 11, which carries a reversing valve spool, generally indicated by the numeral 12 (FIGS. 2 and 3). As shown in FIG. 3, the ends of the valve spool 12 are enclosed by a pair of valve retainers, generally indicated by the numerals 13 and 14.

Figure 4:
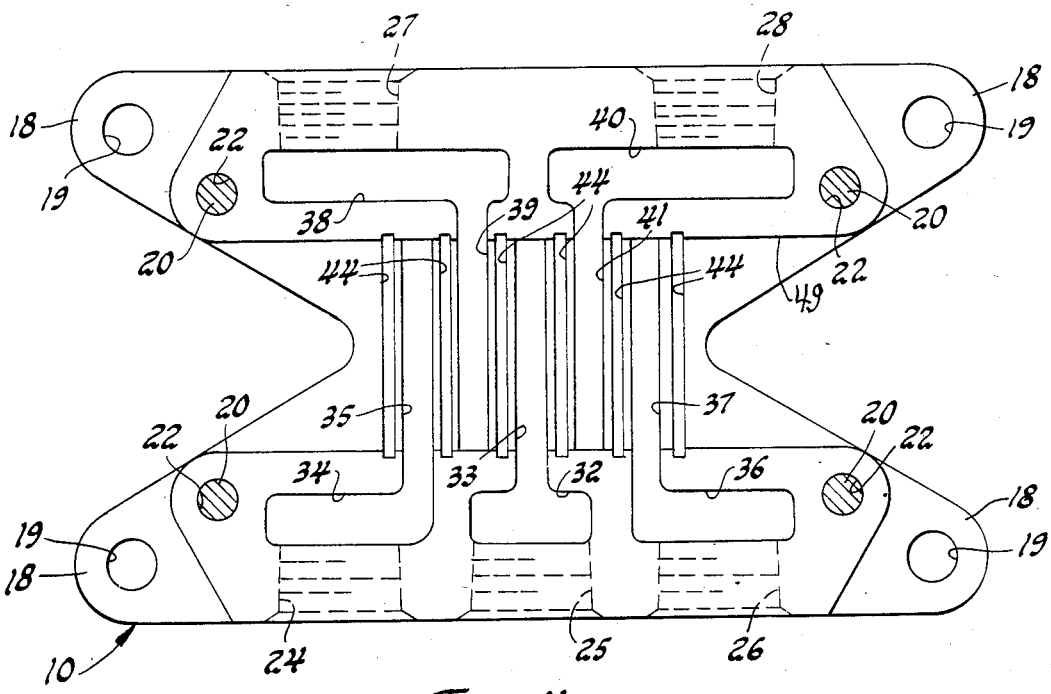
FIG. 4 is a top plan view of the valve base of the valve illustrated in FIG. 1, with the valve spool removed, taken along the line 4—4 thereof, and looking in the direction of the arrows.
Figure 5:
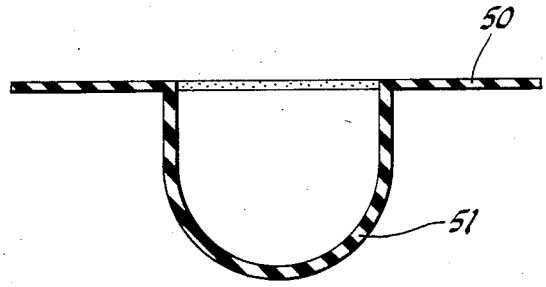
FIG. 5 is a vertical cross-section view of a gasket member employed between the valve body and the valve base.

As best seen in FIG. 4, the valve base 10 is provided with a plurality of attachment feet or extensions 18, through which are formed holes 19 for the reception of suitable mounting bolts, or the like. As shown in FIGS. 1, 2 and 3, the valve body 11 includes a top plate 17. As illustrated in FIG. 1, the valve body top plate 17 is releasably secured to the valve base 10 by a plurality of suitable socket head screws 20, which pass through suitable holes 21 in the plate 17, and into threaded engagement with suitable holes 22 in the valve base 10 (FIG. 4).

As shown in FIGS. 1 and 4, the valve base 10 is provided on one side thereof with a central, inwardly extended, threaded inlet port 25, which is adpated to be connected in the usual manner to a source of pressurized fluid, such as a pressurized air source or pressurized hydraulic oil source. Formed on the opposite sides of the port 25, and in horizontal alignment therewith are a pair of threaded exhaust ports 24 and 26. Formed on the opposite side of the valve base 10 are a pair of horizontally aligned cylinder ports 27 and 28.

As best seen in FIGS. 2, 3 and 4, the valve base 10 has formed therethrough a horizontal, longitudinal U-shaped cavity or chamber 49 which is open at the longitudinal ends thereof, and open at the top side thereof. The aforementioned ports 24 through 28 communicate with the U-shaped chamber 49 by the following described passage means. As shown in FIGS. 2 and 4, the inlet port 25 communicates at its inner end with a vertical passage 32 which is open at the upper end thereof, and which is substantially rectangular in elevation and plan views as shown in FIGS. 2 and 4.

The vertical passage 32 communicates at a central point along its inner side with an inwardly extended passage 33 which has a vertical portion and a horizontal portion that is formed in the peripheral walls of the longitudinal chamber 49. The passage 33 is substantially rectangular in plan and elevation views. The vertical shape of the passage 33 is shown in FIG. 2, and the plan view thereof is shown in FIG. 4. The plan view of the communicating passages 32 and 33 is T-shaped, as shown in FIG. 4.

As shown in FIG. 4, the exhaust ports 24 and 26 commmunicate at their inner ends with a vertical passage 34 and 36, respectively. The passages 34 and 36 are vertical and rectangular in plan and elevation views in the same manner as passage 33. The passages 34 and 36 are substantially rectangular in plan configuration, as shown in FIG. 4. The passages 34 and 36 communicate, at the ends thereof which are adjacent the passage 32, with the transverse passages 35 and 37, respectively. The transverse passages 35 and 37 are each formed in the same vertical and rectangular shape and disposition as the inlet passage 33. The inlet passage 33 is centrally disposed between the exhaust passages 35 and 37. The passages 33, 35 and 37 are transversely disposed, as shown in FIG. 4. As shown in FIG. 4, the plan view of each of the combined passages 34 and 35, and the combined passages 36 and 37, is L-shaped.

The first cylinder port 27 communicates at its inner end with a vertical and rectangular passage 38, which in turn communicates with a transverse passage 39, so as to form a combined passage which is L-shaped in plan configuration. The passage 39 is transversely disposed and it is shaped vertically and rectangularly in the same manner as the inlet transverse passage 33, and it is evenly disposed between the inlet transverse passage 33 and the transverse exhaust passage 35. As shown in FIG. 4, the second cylinder port 28 communicates at its inner end with a vertical passage 40, which is substantially rectangular in plan and elevation view. The vertical passage 40 communicates with a transverse passage 41, formed the same as passage 38, to form a combined passage which is L-shaped in plan view. The transverse passage 41 is shaped vertically and rectangularly in the same manner as the inlet passage 33 in FIG. 2, and it is evenly spaced apart between the inlet passage 33 and the exhaust passage 37. The passages 38 and 40 are formed vertically and rectangularly in the same manner as the passages 32, 34 and 36.

The valve base 10 is provided with an O-ring groove 44 on each side of the transverse passages 33, 35, 37, 39, and 41 for the reception of O-ring type seals 51, as explained hereinafter. The O-ring type seals 51 are not shown in the O-ring grooves 44 in FIG. 4, but they are shown in the O-ring grooves 44 in FIG. 3.

As shown in FIG. 2, the valve body 11 includes a valve body member 48 which is integrally attached at its upper end to the lower side of the valve body attachment plate 17. The valve body member 48 is an elongated member, as shown in FIG. 3, and it is integral along the central portion of the plate 17, as shown in FIG. 2. The outer surface of the valve body member 48 is substantially U-shaped, so as to be seated in the mating, longitudinal U-shaped chamber 49 in the valve base 10. A suitable gasket 50 is disposed between the top end of the valve base 10 and the lower face of the cover plate 17, and it extends on opposite sides of the valve body member chamber 49. Integrally attached to the lower side of the gasket 50, are a plurality of O-ring type seals 51 which are U-shaped and adapted to be seated in the O-ring grooves 44 in the valve base 10 when the valve is fully assembled, as shown in FIG. 3.

As shown in FIGS. 2 and 4, the valve body member 48 is provided with a longitudinally extended valve spool bore 54, which extends completely through the valve body member 48, and it is open to each end thereof. Operatively seated in the valve spool bore 54, is the reversing valve spool 12, which includes a valve spool sleeve, generally indicated by the numeral 55, and a slidable, telescopically mounted valve spool element in the sleeve 55 which is generally indicated by the numeral 56.

As shown in FIG. 3, the valve spool sleeve 55 is provided with a plurality of longitudinally spaced apart O-ring grooves 57 around the outer surface thereof, and in each of which is operatively mounted a suitable O-ring 47. The O-rings 47 sealingly engage the surface of the cylindrical valve bore 54. As shown in FIG. 3, the valve spool sleeve 55 is provided with an upper and lower transverse passage or slot between each of the O-rings 57, as indicated by the numerals 58 through 62. As shown in FIG. 3, when the valve body 11 is mounted in the valve base 10, the valve spool sleeve transverse passages 58 through 62 communicate with the valve base transverse slots, or passages 35, 39, 33, 41 and 37, respectively, through interconnecting aligned passages 35*a*, 39*a*, 33*a*, 41*a*, and 37*a*, which are formed through the lower end of the valve body member 48. As shown in FIG. 3, the valve spool element 56 is provided with a pair of spaced apart, reduced diameter portions, so as to form a pair of annular passages 63 around the valve spool element 56.

As shown in FIG. 3, the right end of the longitudinal valve spool bore 54 is enclosed by the valve retainer 14 which is disposed in a larger diameter stepped bore 69. The valve retainer 14 is releasably secured in the stepped diameter bore 69 by means of a releasable snap retainer ring 70, and with the inner end 66 thereof in abutment with the outer right end 67 of the valve spool sleeve 55. The valve retainer 14 has an inwardly extended axial recess 65 on the inner side thereof into which is extended the right end of the valve spool element 56 when the valve spool element 56 is in the initial operating position shown in FIG. 3. The right end 64 of the valve spool element 56 is seated against a shoulder formed by the juncture of the recess 65 and the reduced diameter recess 74 in the valve retainer 14. The valve spool element 56 has an axial recess 73 formed in the right end thereof which communicates with the recess 74 in the valve retainer 14 to provide a pilot air chamber that is connected by a threaded port 75 to the exterior of the valve. A suitable O-ring seal 71 is operatively mounted in an O-ring seal groove 68 formed around the outer periphery of the valve retainer 14, and it sealingly engages the surface of the stepped diameter recess 69.

As shown in FIG. 3, the valve spool element 56 is normally biased to the right, to the initial operating position, by a suitable return spring 84, into an abutting position against the valve retainer 14. The return spring 84 is mounted in the valve retainer 13 which is releasably mounted in a stepped diameter bore 87 in the left end of the valve body member 48. The valve retainer 13 is mounted so that its inner end seats against the left end of the valve spool sleeve 55. The valve retainer 13 is releasably secured in position by a releasable snap retainer ring 70. A suitable O-ring 71 is also mounted in the outer periphery of the valve retainer 13 in a suitable O-ring groove 68. The return spring 84 is operatively mounted with its inner end seated in an annular recess 86 that is formed in the left end of the valve spool element 56. The outer end of the return spring 84 is operatively mounted in a stepped diameter recess formed by the two diameter recesses 83 and 85 that extend into the valve retainer 13 from the inner face thereof. A suitable vent passage 82 is formed through the outer end of the valve retainer 13 to relieve any air pressure inside of the valve retainer 13.

In use, it will be seen that the valve spool element 56 may be moved from its initial operating position shown in FIG. 3, to the left against the pressure of the return spring 84 by conducting pressurized pilot air into the chamber 74 for reaction against the valve spool element 56 to move it to its second operating position. After the pilot air pressure is exhausted from the chamber 74, the return spring 84 returns the valve spool element 56 to the initial operating position shown in FIG. 3. The pilot air may be supplied to the chamber 74 from any suitable source. The pilot air source may be connected as by means of a conduit 78 to a flow control valve 77. The flow control valve 77 would have an exhaust line 79, and a line 76 connected to the chamber 74. When the flow control valve 77 is in the position shown in FIG. 3, the pilot air would be exhausted from the chamber 74. When the valve 77 is moved to the left by any suitable means, as by manual means or solenoid operated means, the chamber 74 would be connected to the source of pilot air to conduct pressurized pilot air into the chamber 74 for moving the valve spool element 56 to the left, to its second operating position.

In the initial operating position, the valve spool element 56 is positioned so that the right annular passage 63 of the valve element 56 is positioned to connect the cylinder #2 passage 41 to the exhaust passage 37 so as to connect the port 28 for cylinder #2 to the exhaust port 26. Simultaneously, the left annular passage 63 of the valve element 56 is positioned to connect the fluid inlet passage 33 with the cylinder #1 passage 39 for conducting pressurized fluid to the port 27 for cylinder #1. When the valve spool element 56 is shifted to the left position, with the left end thereof into seating engagement against the shoulder formed by the juncture of the recesses 83 and 85, the aforedescribed fluid flow action is reversed; that is, cylinder #1 would be connected to the exhaust port 24, while cylinder #2 would be connected to the inlet port 25.

It will be seen, that when the valve spool element 56 is in either the initial or first operating position shown in FIG. 3, or in the second operating position with the valve spool element 56 shifted to the left, that in both circumstances the flow of fluid through the valve is on the same plane, and the fluid does not have to make any vertical upward or downward movements, thereby eliminating vertical right hand turns in the flow of fluid. It will be seen that the valve of the present invention provides a compact valve which is low in height.

It will also be seen that the valve of the present invention provides all of the advantages of the prior art base mounted valves, and that the valve body 11 which carries the reversing valve spool structure 12 can be quickly and easily removed from the valve base 10 without moving the valve base 10 from its operative location. That is, the valve spool 12 can be removed from the valve base 10 without removing the pipes, conduits and other conducting elements which are normally attached to the ports 24 through 28 for conveying fluid to and from an apparatus to be controlled by the valve of the present invention. Another advantage of the valve of the present invention, is that it can be used in a stacking arrangement in the same manner as the prior art stacking valves. The straight through, uniplanar flow path of the valve of the present invention provides a valve with optimum flow efficiency.

The reversing valve spool structure 12 illustrates one type of a reversing type valve spool which may be employed, namely, the illustrated type which includes the valve spool sleeve and the valve spool element 56. However, it will be understood that other types of conventional reversing valve spools may be employed wherein the valve spool sleeve 55 is eliminated and the valve spool 56 is slidably mounted directly in the valve spool bore 54 in the valve spool body member 48. The valve spool element 56 is shown as being slidably mounted in the sleeve 55 without any seals, and this is a conventional type of valve which employs a floating sleeve with a lapped spool. It will be understood that if a conventional valve spool 12 is employed which does not include the sleeve 55, then the reversing valve spool element 56 may also be mounted directly in the bore 54 in the valve spool body member 48 without the need for any seals when a corresponding lapped spool arrangement is employed. On the other hand, any type of sealing means may be employed between the last mentioned type reversing valve spool element 56 and a mating bore in the valve body member 48, for example, O-ring seals, molded type seals, such as elastomeric seals, and plastic seals. Although the reversing valve spool element 56 is illustrated as being shifted in one direction by pilot air, and in a return direction by a return spring, it will be understood that other means for moving the reversing valve spool element 56 may be employed. For example, a direct connected solenoid for engagement with one end of the reversing valve spool element 56 so as to directly move the reversing valve spool element 56 in one direction with a return spring to move it in the other direction. The reversing valve spool element 56 may be moved in both directions by a directly operated solenoid. It will also be understood that pressurized pilot air may be employed to operate the reversing valve spool element 56 in both directions, with the pilot air being controlled by solenoid operated valves. The reversing valve spool element 56 may also be operated manually in one direction or the other, or in both directions.

INDUSTRIAL APPLICABILITY

The valve of the present invention is adapted for use in industrial air and hydraulic fluid flow control valves of the three-way or four-way reversing spool type, and the like, for directing fluid to control apparatuses, such as cylinders for machine tool operations, and other industrial applications.

I claim:

1. A reversing fluid flow control valve having a valve base which has a top side and a lower side, and a valve spool body characterized in that:

(a) said valve base is provided with an elongated, longitudinal shaped cavity which is open along the top side thereof;

(b) said valve base includes an inlet port, having a longitudinal axis, connected to a vertical, rectangular, inlet passage communicating with said cavity;

(c) said valve base includes at least one cylinder port, having a longitudinal axis, connected to a vertical, rectangular cylinder passage communicating with said cavity;

(d) said valve base includes at least one exhaust port, having a longitudinal axis, connected to a vertical, rectangular exhaust passage communicating with said cavity;

(e) said valve spool body is removably seated in said cavity in the valve base and has vertical, rectangular, inlet, cylinder and exhaust passage which are verticaly aligned with the inlet, cylinder and exhaust passages in the valve base, and the valve spool body has movably mounted therein a reversing valve spool having a longitudinal axis, for controlling the flow of fluid between said inlet passages and said cylinder passages, and between said cylinder passages and said exhaust passages;

(f) means for releasably securing the valve spool body to the valve base; and, (g) the lower side of said valve spool body having a shape complementary with the shape of the cavity in the valve base, and said ports are disposed in uniplanar positions relative to each other, whereby when fluid passes into said inlet port, it will pass through the valve base and valve spool, and valve spool body in a uniplanar manner, and out through said cylinder port.

2. A reversing fluid flow control valve as defined in claim 1, characterized in that:

(a) said valve base includes a pair of cylinder ports and cylinder passages;

(b) said valve base includes a pair of exhaust ports and exhaust passages; and, (c) said reversing valve spool controls the flow of fluid in a uniplanar manner between said inlet passage and one of said cylinder passages, and between one of said cylinder passages and one of said exhaust passages.

3. A reversing fluid flow control valve as defined in either one of claims 1 or 2, characterized in that:

(a) the longitudinal axes of said ports and the longitudinal axis of said reversing valve spool are substantially uniplanar when the valve spool body is mounted in the valve base.

4. A reversing fluid flow control valve as defined in claim 3, characterized in that:

(a) the shape of the cavity in the valve base is an arcuate shape, and the complementary shape on the lower side of said valve spool body is an arcuate shape.

5. A reversing fluid flow control valve as defined in claim 4, characterized in that:

(a) said valve base is open at each end thereof.

* * * * *